US006073680A

United States Patent [19]

Folder

[11] Patent Number: 6,073,680

[45] Date of Patent: Jun. 13, 2000

[54] STRIP CASTING

[75] Inventor: William John Folder, Kiama Downs, Australia

[73] Assignees: Ishikawajima-Harima Heavy Industries Company Limtied, Melbourne, Australia; BHP Steel (JLA) Pty Ltd, Tokyo, Japan

[21] Appl. No.: 09/226,146

[22] Filed: Jan. 7, 1999

[51] Int. Cl.[7] ..... B22D 11/06

[52] U.S. Cl. ..... 164/480; 164/428

[58] Field of Search ..... 164/480, 428, 164/437, 489

[56] References Cited

U.S. PATENT DOCUMENTS 5,178,204 1/1993 Fukage et al. ..... 164/437

FOREIGN PATENT DOCUMENTS 63-76752 4/1988 Japan ..... 222/606
63-132754 6/1988 Japan ..... 164/437
64-5650 1/1989 Japan ..... 164/437

*Primary Examiner*—Kuang Y. Lin
*Attorney, Agent, or Firm*—Miles & Stockbridge P.C.; John C. Kerins

[57] ABSTRACT

A refractory nozzle 19 for delivery of molten metal to a casting pool 68 of a twin roll caster, and a method and apparatus for casting strip 20 is disclosed in which said nozzle 19 has an elongate open topped trough 61 to receive molten metal, a pair of elongate nozzle chambers 82 extending one along each side of a floor 60 of a trough, metal flow openings 86 for flow of molten metal from the interior of the trough into the nozzle side chambers 82, and nozzle side outlets 64 for flow of molten metal from the side chambers 82 outwardly from the bottom of the delivery nozzle. In a preferred form the nozzle side outlets 64 are elongate slots extending continuously substantially throughout the length of the nozzle and the nozzle side chambers 82 are formed by partition walls 83, 84 disposed within the nozzle to divide off bottom side corner parts of the nozzle from the trough interior whereby the form said side chambers 82 extending along the bottom side corner parts of the nozzle.

13 Claims, 9 Drawing Sheets

STRIP CASTING

TECHNICAL FIELD

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and tend to produce defects caused by uneven solidification at the chilled casting surfaces of the rolls. Much attention has therefore been given to the design of metal delivery nozzles aimed at producing a smooth even flow of metal to and within the casting pool. U.S. Pat. Nos. 5,178,205 and 5,238,050 both disclose arrangements in which the delivery nozzle extends below the surface of the casting pool and incorporates means to reduce the kinetic energy of the molten metal flowing downwardly through the nozzle to a slot outlet at the submerged bottom end of the nozzle. In the arrangement disclosed in U.S. Pat. No. 5,178,205 the kinetic energy is reduced by a flow diffuser having a multiplicity of flow passages and a baffle located above the diffuser. Below the diffuser the molten metal moves slowly and evenly out through the outlet slot into the casting pool with minimum disturbance. In the arrangement disclosed in U.S. Pat. No. 5,238,050 streams of molten metal are allowed to fall so as to impinge on a sloping side wall surface of the nozzle at an acute angle of impingement so that the metal adheres to the side wall surface to form a flowing sheet which is directed-into an outlet flow passage. Again the aim is to produce a slowly moving even flow from the bottom of the delivery nozzle so as to produce minimum disruption of the casting pool.

Japanese Patent Publication 5-70537 of Nippon Steel Corporation also discloses a delivery nozzle aimed at producing a slow moving even flow of metal into the casting pool. The nozzle is fitted with a porous baffle/diffuser to remove kinetic energy from the downwardly flowing molten metal which then flows into the casting pool through a series of apertures in the side walls of the nozzle. The apertures are angled in such a way as to direct the in-flowing metal along the casting surfaces of the rolls longitudinally of the nip. More specifically, the apertures on one side of the nozzle direct the in-flowing metal longitudinally of the nip in one direction and the apertures on the other side direct the in-flowing metal in the other longitudinal direction with the intention of creating a smooth even flow along the casting surfaces with minimum disturbance of the pool surface.

After an extensive testing program we have determined that a major cause of defects is premature solidification of molten metal in the regions where the pool surface meets the casting surfaces of the rolls, generally known as the "meniscus" or "meniscus regions" of the pool. The molten metal in each of these regions flows towards the adjacent casting surface and if solidification occurs before the metal has made uniform contact with the roll surface it tends to produce irregular initial heat transfer between the roll and the shell with the resultant formation of surface defects, such as depressions, ripple marks, cold shuts or cracks.

Previous attempts to produce a very even flow of molten metal into the pool have to some extent exacerbated the problem of premature solidification by directing the incoming metal away from the regions at which the metal first solidifies to form the shell surfaces which eventually become the outer surfaces of the resulting strip. Accordingly, the temperature of the metal in the surface region of the casting pool between the rolls is significantly lower than that of the incoming metal. If the temperature of the molten metal at the pool surface in the region of the meniscus becomes too low then cracks and "meniscus marks" (marks on the strip caused by the meniscus freezing while the pool level is uneven) are very likely to occur. One way of dealing with this problem has been to employ a high level of superheat in the incoming metal so that it can cool within the casting pool without reaching solidification temperatures before it reaches the casting surfaces of the rolls. In recent times, however, it has been recognised that the problem can be addressed more efficiently by taking steps to ensure that the incoming molten metal is delivered relatively quickly by the nozzle directly into the meniscus regions of the casting pool. This minimises the tendency for premature freezing of the metal before it contacts the casting roll surfaces. It has been found that this is a far more effective way to avoid surface defects than to provide absolutely steady flow in the pool and that a certain degree of fluctuation in the pool surface can be tolerated since the metal does not solidify until it contacts the roll surface. Examples of this approach are to be seen in Japanese Patent Publication No 64-5650 of Nippon Steel Corporation and the present applicants' Australian Patent Application No 60773/96.

In order to ensure that the incoming molten metal is delivered relatively quickly into the meniscus regions of the casting pool, it is necessary to employ delivery nozzles with side outlet openings to deliver the metal laterally outwardly from the bottom part of the delivery nozzle toward the casting rolls. Accordingly, the delivery nozzle is required to capture a downwardly falling stream of molten metal and produce steady outward flow of metal through the side delivery openings with as little turbulence and flow fluctuation as possible. This requires that the downward kinetic energy of the incoming stream be absorbed and that essentially non-turbulent conditions be established at the side delivery openings. Moreover, this must be achieved within the very confined space within the bottom of the delivery nozzle without significant restriction of the flow. The previous baffle and diffuser arrangements are not suitable for this purpose but the present invention provides a simple method and means whereby this may be achieved.

DISCLOSURE OF THE INVENTION

According to the invention there is provided a method of casting metal strip comprising:

introducing molten metal between a pair of chilled casting rolls via an elongate metal delivery nozzle disposed above and extending along the nip between the rolls to form a casting pool of molten metal supported above the nip, and rotating the rolls so as to cast a solidified strip delivered downwardly from the nip;

wherein the metal delivery nozzle comprises an upwardly opening trough to receive molten metal extending longitudinally of the nip, the molten metal is caused to flow from the nozzle into the casting pool through side outlets from the nozzle, the side outlets communicate with a pair of nozzle side chambers extending one along each side of a floor of the trough and projecting upwardly therefrom, and molten metal is delivered downwardly into the trough and caused to flow from the trough into the side chambers before flowing from the chambers through said side outlets into the casting pool. Preferably the side outlets are elongate slots extending continuously substantially throughout the length of the nozzle so as to produce outwardly directed curtain flows of molten metal into the casting pool.

Preferably the molten metal is delivered downwardly into the trough to impinge on a bottom floor of the trough between the side chambers. It may be delivered in a series of discrete free falling streams spaced apart longitudinally of the trough or in a free falling continuous curtain stream extending along the trough.

The invention also provides apparatus for casting metal strip, comprising a pair of parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle, wherein the metal delivery nozzle comprises an upwardly opening elongate trough extending longitudinally of the nip to receive molten metal from the distributor, a pair of elongate nozzle chambers extending one along each side of a floor of the trough and projecting upwardly therefrom, metal flow passages for flow of molten metal from the interior of the trough into the nozzle side chambers, and nozzle side outlets for flow of molten metal from the side chambers outwardly from the bottom of the delivery nozzle.

Preferably, the nozzle side outlets are elongate slots extending continuously substantially throughout the length of the nozzle.

Preferably too the nozzle side chambers are formed by partition walls disposed within the nozzle to divide off bottom side corner parts of the nozzle from the trough interior whereby to form said side chambers extending along the bottom side corner parts of the nozzle.

Preferably further, said metal flow passages are formed by openings in said partition walls.

Preferably further, the partition walls comprise a pair of laterally spaced upright walls standing up from a floor of the trough to define inner side walls of said side chambers and chamber top walls extending laterally outwardly from the upper extremities of the upright walls.

The metal flow passages may in that case comprise a series of longitudinally spaced openings in each of the upright walls defining the inner side walls of the side chambers.

Alternatively, or in addition, the metal flow passages may comprise a series of longitudinally spaced openings in the chamber top walls.

The metal distributor may be operable to deliver the molten metal downwardly into the trough between the side chambers to impinge on the trough floor between the side chambers and flow outwardly against chamber side walls.

The invention also provides a refractory nozzle for delivery of molten metal to a casting pool, of a twin roll caster, said nozzle comprising an elongate open topped trough to receive molten metal, a pair of elongate nozzle chambers extending one along each side of a floor of the trough and projecting upwardly therefrom, metal flow passages for flow of molten metal from the interior of the trough into the nozzle side chambers, and nozzle side outlets for flow of molten metal from the side chambers outwardly from the bottom of the delivery nozzle.

BRIEF DESCRIPTION OF THE DRAWINGS

In order that the invention may be more fully explained one particular method and apparatus will be described in some detail with reference to the accompanying drawings in which.

DETAILED DESCRIPTION OF THE PREFERRED EMBODIMENT

Figure 1:
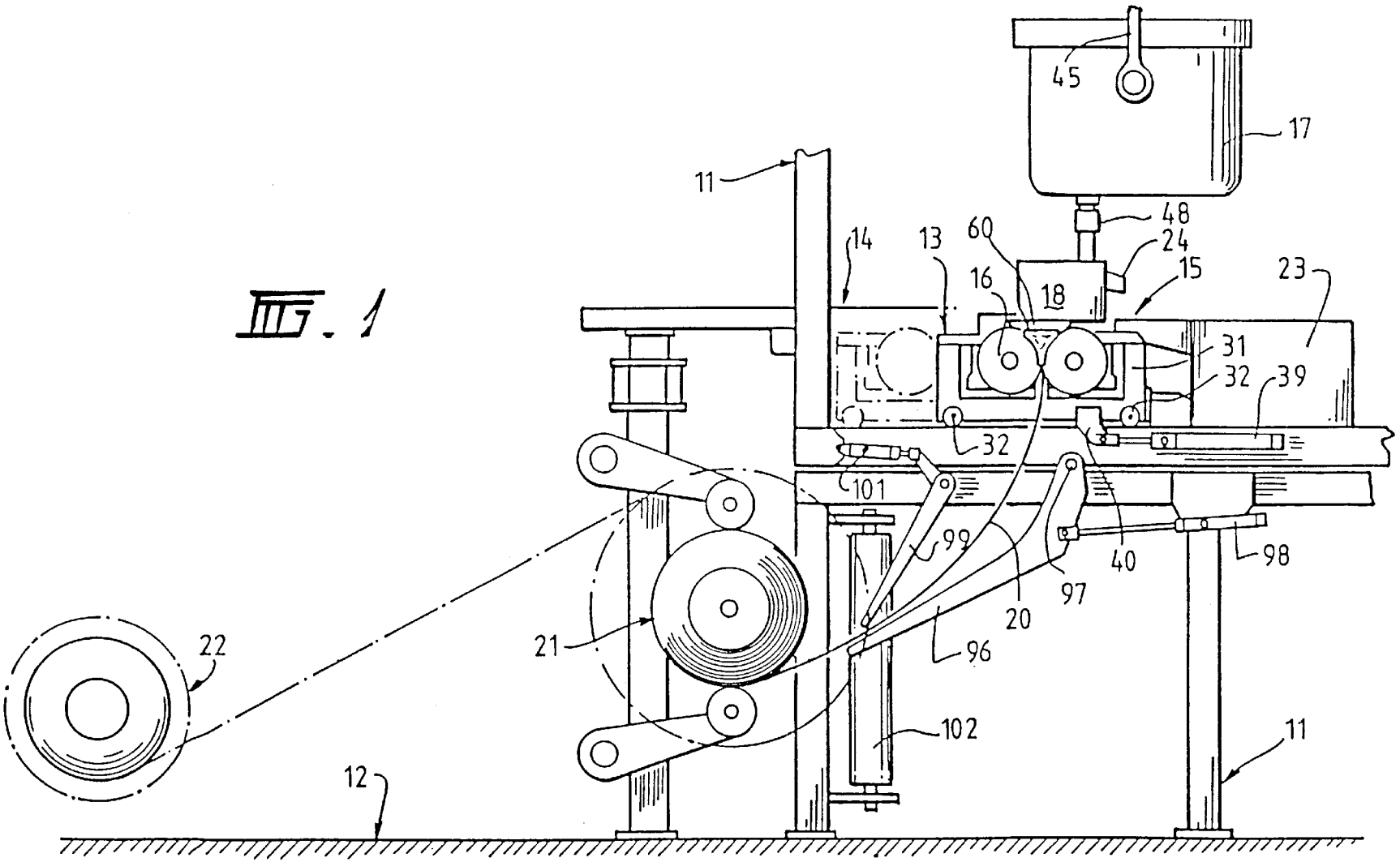
FIG. 1 illustrates a twin-roll continuous strip caster constructed and operating in accordance with the present invention.
Figure 2:
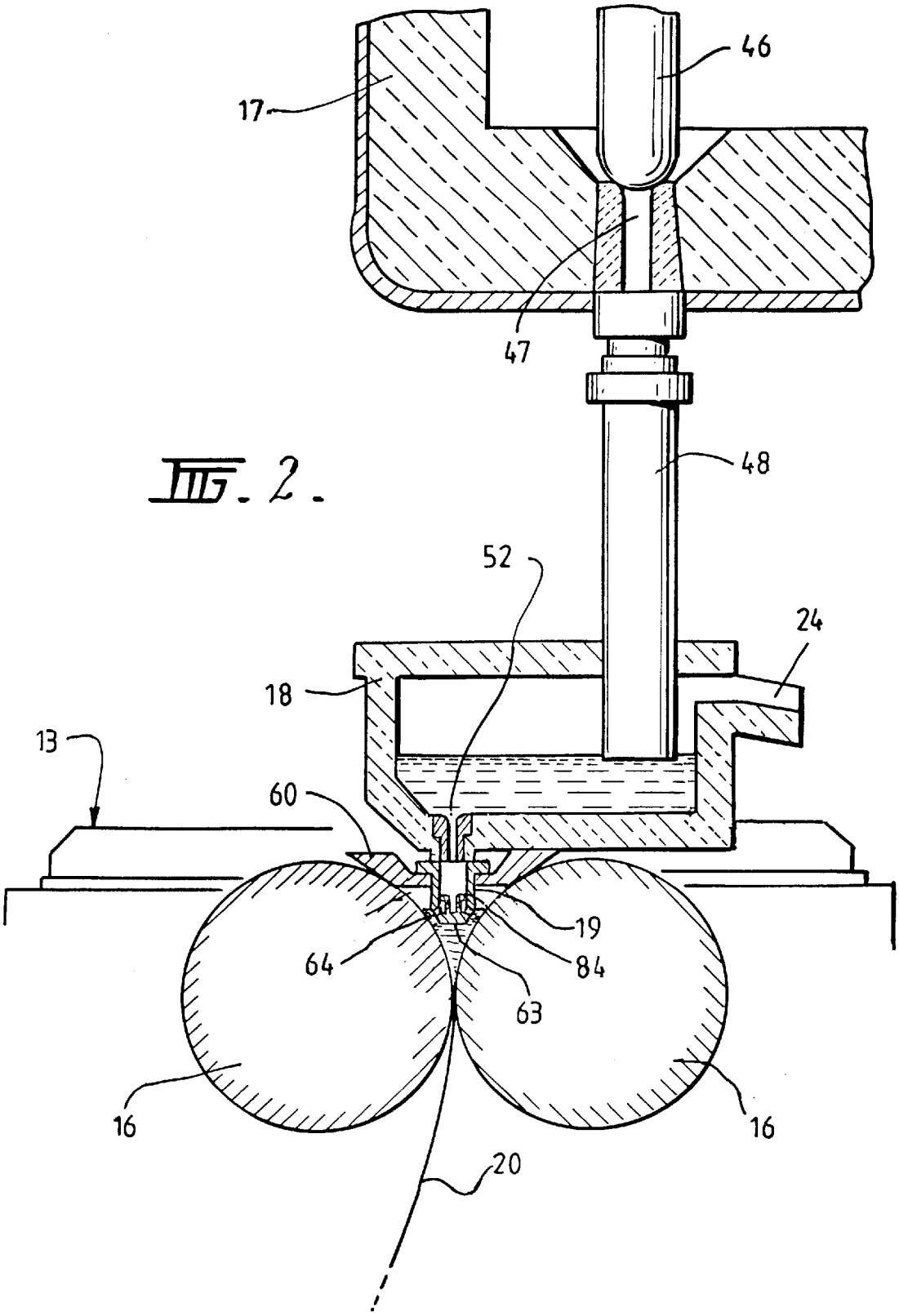
FIG. 2 is a vertical cross-section through important components of the caster illustrated in FIG. 1 including a metal delivery nozzle constructed in accordance with the invention.
Figure 3:
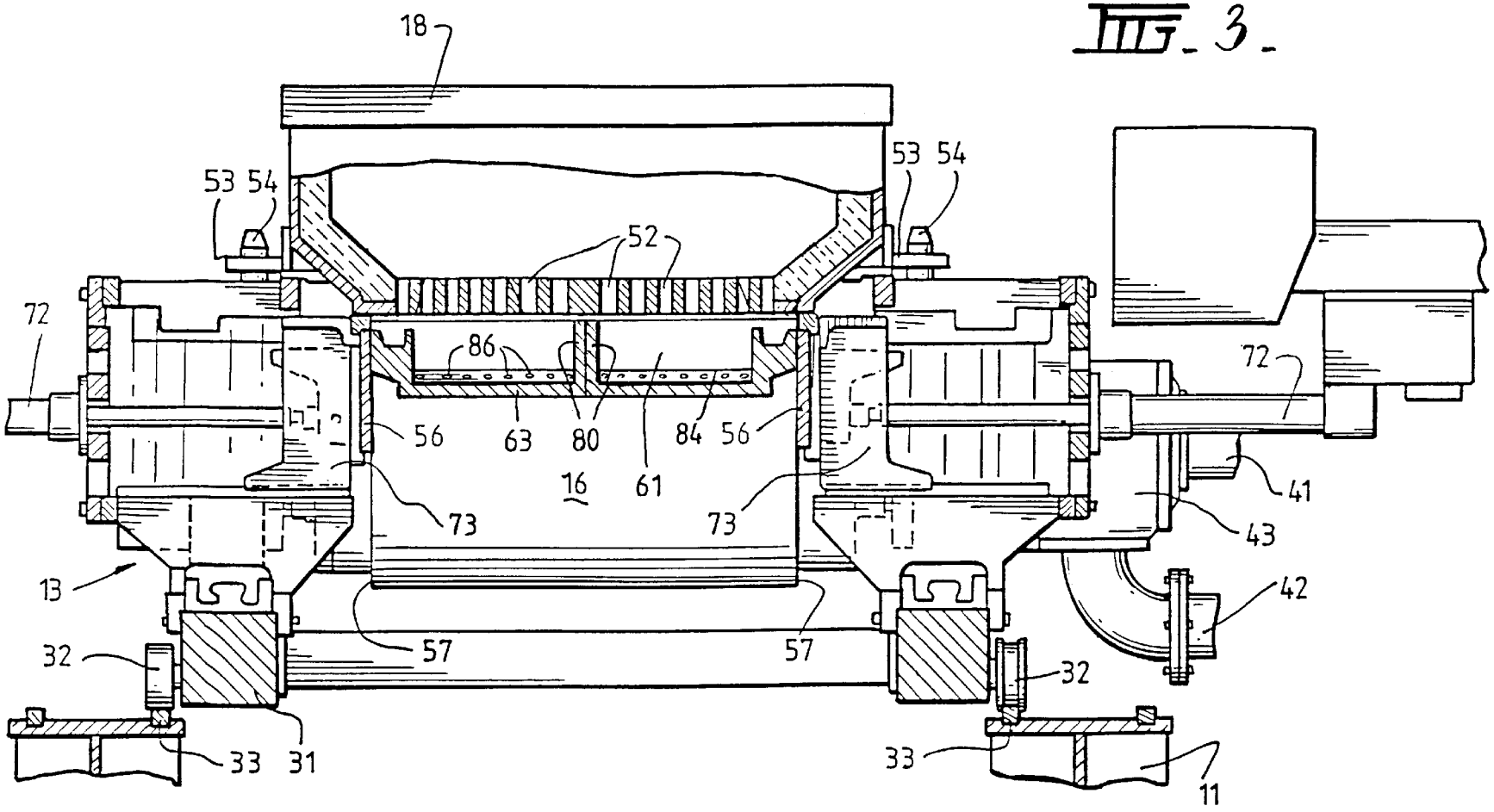
FIG. 3 is a further vertical cross-section through important components of the caster taken transverse to the section of FIG. 2.
Figure 4:
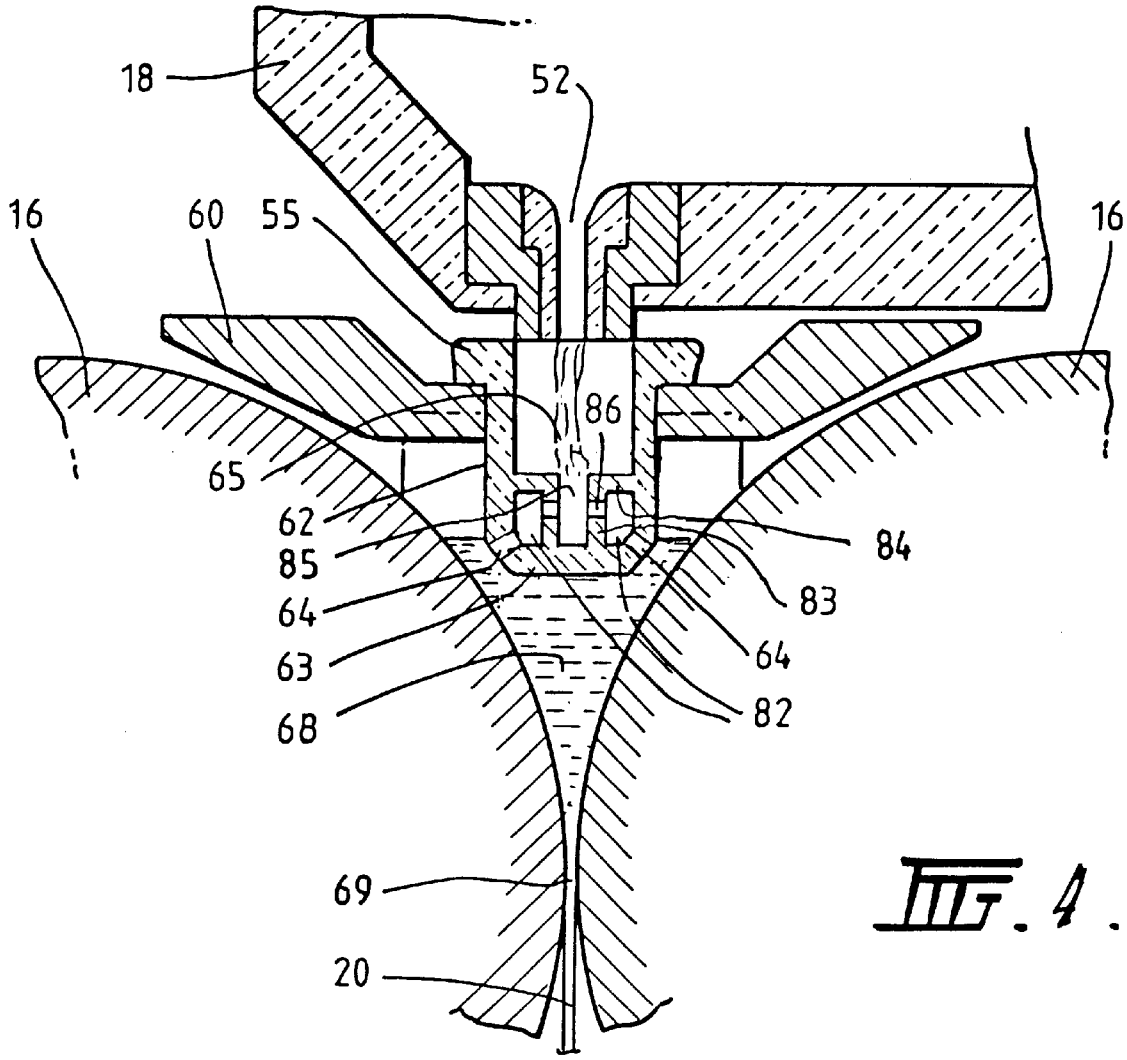
FIG. 4 is an enlarged transverse cross-section through the metal delivery nozzle and adjacent parts of the casting rolls.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Figure 5:
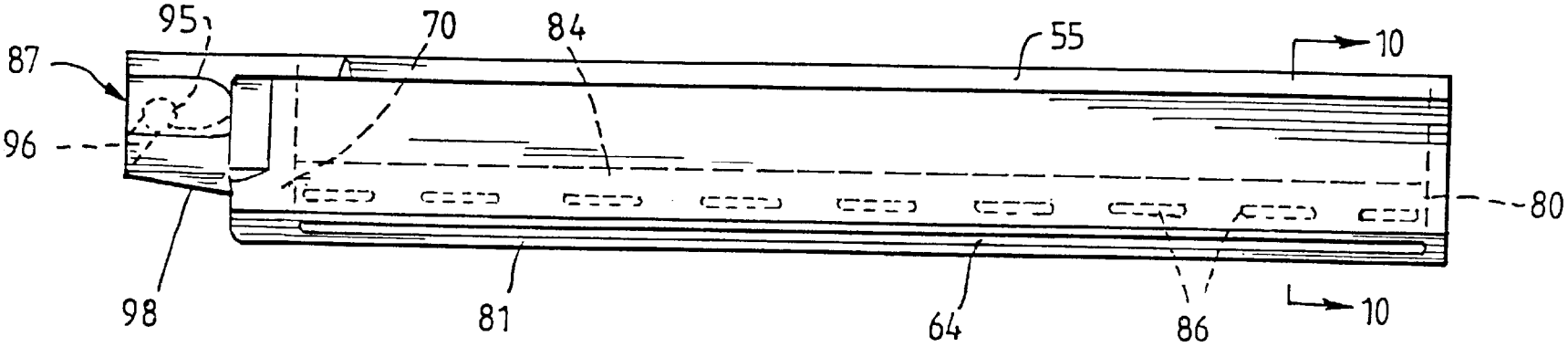
FIG. 5 is a side elevation of a one half segment of the metal delivery nozzle.
Figure 6:
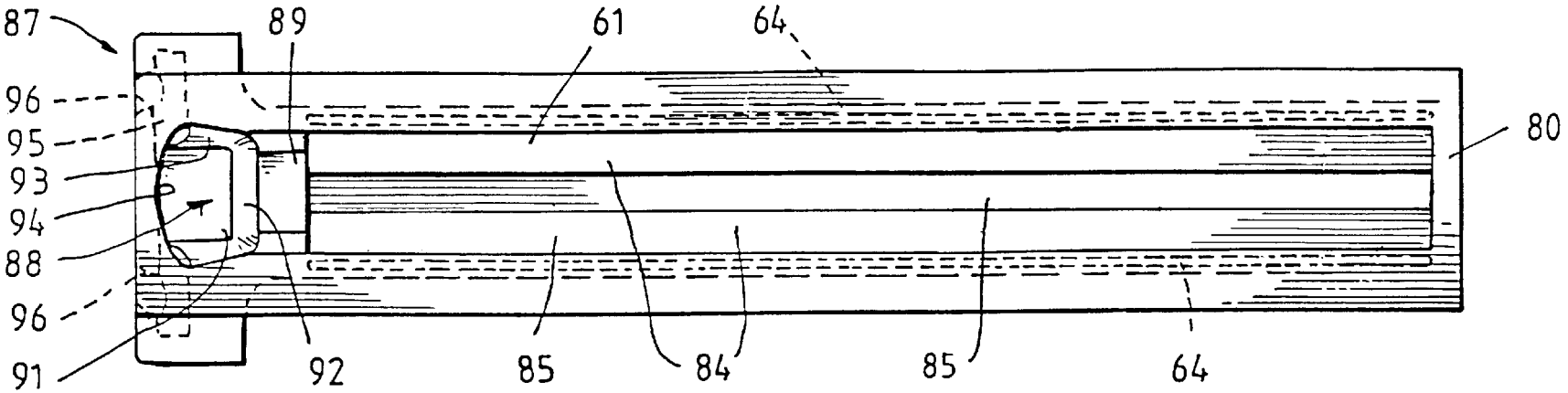
FIG. 6 is a plan view of the nozzle segment shown in FIG. 5.
Figure 7:
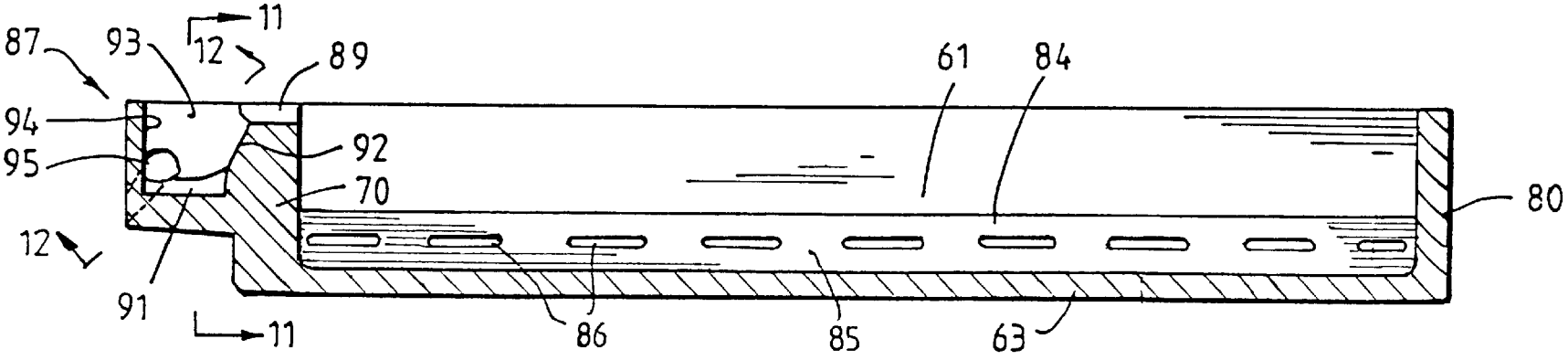
FIG. 7 is a longitudinal cross-section through the delivery nozzle segment.
Figure 8:
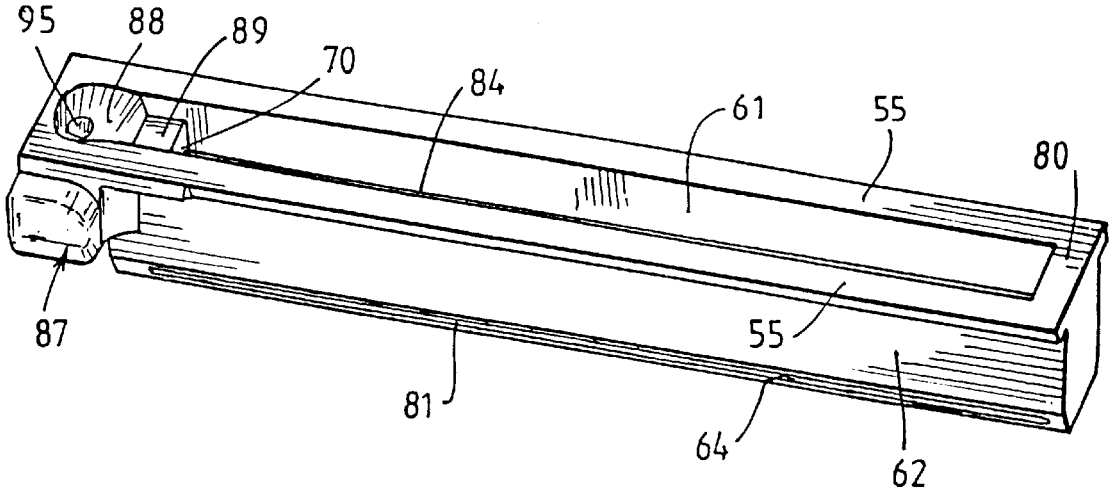
FIG. 8 is a perspective view of the delivery nozzle segment.
Figure 9:
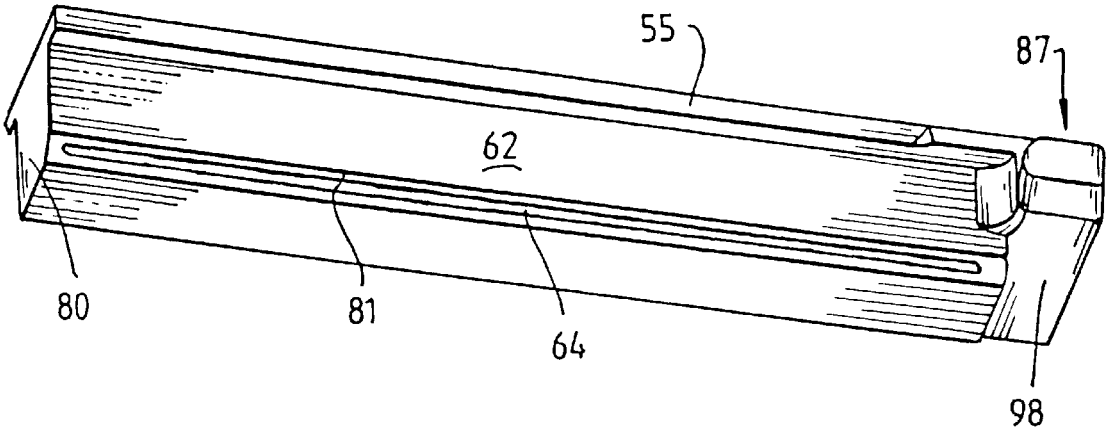
FIG. 9 is an inverted perspective view of the nozzle segment.
Figure 10:
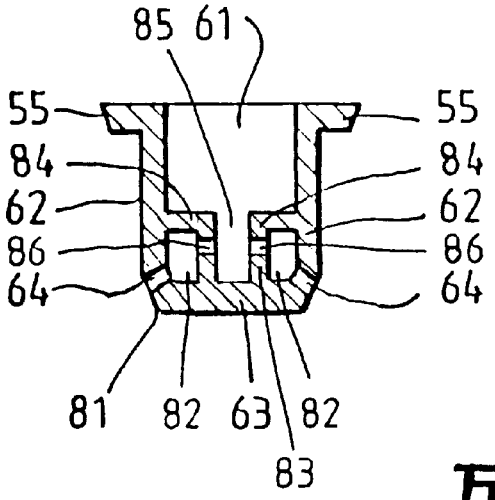
FIG. 10 is a transverse cross-section through the delivery nozzle segment on the line 10—10 in FIG. 5.
Figure 11:
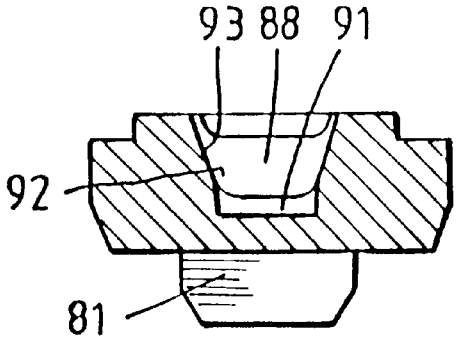
FIG. 11 is a cross-section on the line 11—11 in FIG. 7.
Figure 12:
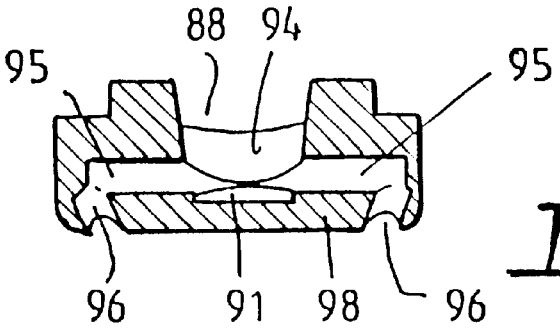
FIG. 12 is a cross-section on the line 12—12 in FIG. 7.

Delivery nozzle 19 is formed in two identical half segments which are made of a refractory material such as alumina graphite are held end to end to form the complete nozzle. FIGS. 5 to 11 illustrate the construction of the nozzle segments which are supported on the roll carriage frame by a mounting bracket 60, the upper parts of the nozzle segments being formed with outwardly projecting side flanges 55 which locate on that mounting bracket.

Each nozzle half segment is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle segments which are brought together in the completed nozzle. The bottom of the trough is closed by a horizontal bottom floor 63 which meets the trough side walls 62 at chamfered bottom corners 81. The nozzle is provided at these bottom corners with elongate outlets outlet slot 64 extending substantially throughout the length of the nozzle. Slots 64 are positioned to provide for flow of molten metal outwardly from the bottom of the delivery nozzle in two continuous curtain jets extending substantially throughout the length of the nozzle.

In accordance with the present invention, a pair of elongate nozzle side chambers 82 are defined by partition walls 83, 84 disposed within the nozzle to divide off the bottom side corner parts of the nozzle from the trough interior. Chambers 82 extend the bottom side corner parts of the nozzle, their inner sides being defined by the upright partition walls 83 standing up from the floor 63 of the nozzle trough and their tops being defined by the partition walls 84 extending laterally outwardly from the upper extremities of the walls 83.

The nozzle outlet slots 64 communicate with the side chambers 82 and they do not communicate directly with the interior of the trough. The chambers 82 receive flows of molten metal from the interior of the trough through metal flow passages in the form of a series of longitudinally spaced openings 86 in each of the inner side walls 83 of the chambers. These side walls form together with the trough floor 63 an internal trough channel 85 to receive the incoming flow of molten metal as described below.

The outer ends of the nozzle segments are provided with end formations denoted generally as 87 extending outwardly beyond the nozzle end wall 70 and provided with metal flow passages to direct separate flows of molten metal to the "triple point" regions of the pool ie. those regions of the pool where the two rolls and the side dam plates come together. The purpose of directing hot metal to those regions is to prevent the formation of "skulls" due to premature solidification of metal in these regions, as is more fully described in our Australian Patent Application No. 31218/97.

Each end wall formation 87 defines a small open topped reservoir 88 to receive molten metal from the distributor, this reservoir being separated from the main trough of the nozzle by the end wall 70. The upper end 89 of end wall 70 is lower than the upper edges of the trough and the outer parts of the reservoir 88 and can serve as a weir to allow back flow of molten metal into the main nozzle trough from the reservoir 88 if the reservoir is over filled, as will be more fully explained below.

Reservoir 88 is shaped as a shallow dish having a flat floor 91, inclined inner and side faces 92, 93 and a curved upright outer face 94. A pair of triple point pouring passages 95 extend laterally outwardly from this reservoir just above the level of the floor 91 to connect with triple point pouring outlets 96 in the undersides of the nozzle end formations 87, the outlets 96 being angled downwardly and inwardly to deliver molten metal into the triple point regions of the casting pool.

Molten metal falls from the outlet openings 52 of the distributor in a series of free-falling vertical streams 65 into the bottom part of the nozzle trough 61. Molten metal flows from this reservoir into the side chambers 82 and through the nozzle outlet slots 64 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are movable by actuation of a pair of hydraulic cylinder units 83 to bring the side plates into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the side outlet slots 64 of the delivery nozzle are disposed immediately beneath the surface of the casting pool. The molten metal flows through the openings 64 in two laterally outwardly directed continuous curtain streams in the general vicinity of the casting pool surface so as to impinge on the cooling surfaces of the rolls in the immediate vicinity of the pool surface throughout the length of the rolls. This maximises the temperature of the molten metal delivered to the meniscus regions of the pool and maintains an even temperature distribution along the rolls. It has been found that this significantly reduces the formation of cracks and meniscus marks on the melting strip surface.

The metal streams 65 fall into the internal trough channel 85 to impinge on the bottom floor 63 of the trough 61 between the two upstanding partition walls 63 forming the inner walls of chambers 82. The impinging metal is thus caused to flow outwardly against the walls 63 to substantially reduce kinetic energy of the metal and also to release entrained gas from the metal before it flows into the side chambers 82. To ensure maximum reduction of kinetic energy, it is important that the walls 63 be vertical and meet the floor 63 at sharply defined corners to produce a double impingement effect.

The outlet openings 52 of the distributor are staggered longitudinally of the nozzle with respect to the flow openings 86 in the walls 63 so that the falling streams 65 impinge on the nozzle floor at locations between successive pairs of flow openings 86. It has been found that the system can be operated to establish a casting pool which rises to a level only just above the bottom of the delivery nozzle so that the casting pool surface is only just above the floor of the nozzle trough and at the same level as the metal within the trough. Under these conditions it is possible to obtain very stable pool conditions and if the outlet slots are angled downwardly to a sufficient degree it is possible to obtain a quiescent pool surface.

The triple point pouring reservoirs 88 receive molten metal from the two outermost streams 65 falling from the distributor 18. The alignment of the two outermost holes 52 in the distributor is such that each reservoir 88 receives a single stream impinging on the flat floor 91 immediately outside the sloping side face 92. The impingement of the molten metal on floor 88 causes the metal to fan outwardly across the floor and outwardly through the triple point pouring passages 95 to the outlets 96 which produce downwardly and inwardly inclined jets of hot metal directed across the faces of the side dams and along the edges of the casting rolls toward the nip. Triple point pouring proceeds with only a shallow and wide pool of molten metal within each of the troughs 88, the height of this pool being limited by the height of the upper end 89 of the wall 70. When reservoir 88 is filled molten metal can flow back over the wall end 89 into the main nozzle trough so that the wall end serves as a weir to control the depth of the metal pool in the triple point pouring supply reservoir 88. The depth of the pool is more than sufficient to supply the triple point pouring passages so as to maintain flow at a constant head whereby to achieve a very even flow of hot metal through the triple point pouring passages. This control flow is most important to proper formation of the edge parts of the strip. Excessive flow through the triple point passages can lead to bulging in the edges of the strip whereas too little flow will produce skulls and "snake egg" defects in the strip.

The undersides 98 of the triple point pouring formations 87 are raised above the surface of the casting pool so as to avoid cooling of the pool surface at the triple point region. Moreover, the undersides 98 are outwardly and upwardly inclined. This is desirable in order to prevent an accumulation of slag or other contaminants from jamming beneath the ends of the nozzle. Such jamming can result in blockage of gas and fumes escaping from the casting pool and the risk of explosion.

The illustrated apparatus has been advanced by way of example only and the invention is not limited to the details of that apparatus. In particular it is not essential to the present invention that the nozzle be provided with triple point pouring formations although that is the presently preferred form of nozzle. The provision of the side chambers 82 in accordance with the invention to produce substantially steady conditions at the outlets 64 enables the outlets 64 to be provided in the form of long slots extending throughout the length of the nozzle and this is the preferred form of nozzle outlet. However, it would be possible alternatively to provide a series of longitudinally spaced outlet slots in each side of the nozzle. Although the flow passages 86 for flow of metal into the chambers 82 are formed in the side walls 83 of the chambers these could be replaced or supplemented by openings in the upper chamber walls 84. It is to be understood that such variations may be made without departing from the spirit and scope of the invention which extends to every novel feature and combination of features herein disclosed.

What is claimed is:

1. A method of casting metal strip comprising:

introducing molten metal between a pair of chilled casting rolls via an elongate metal delivery nozzle disposed above and extending along the nip between the rolls to form a casting pool of molten metal supported above the nip; and rotating the rolls so as to cast a solidified strip delivered downwardly from the nip;

wherein the metal delivery nozzle comprises an upwardly opening trough to receive molten metal extending longitudinally of the nip from a metal distributor the upwardly opening trough having an opening larger than an opening in said metal distributor, the molten metal is caused to flow from the nozzle into the casting pool through side outlets from the nozzle, the side outlets communicate with a pair of nozzle side chambers extending one along each side of a floor of the trough and projecting upwardly therefrom, and molten metal is delivered downwardly into the trough in one or more discrete free falling streams to impinge on a bottom floor of the trough between the side chambers and caused to flow from the trough into the side chambers before flowing from the chambers through said side outlets into the casting pool.

2. A method according to claim 1, wherein the side outlets are elongate slots extending continuously substantially throughout the length of the nozzle so as to produce outwardly directed curtain flows of molten metal into the casting pool.

3. A method according to claim 1, wherein the nozzle side chambers are formed by partition walls disposed within the nozzle to divide off bottom side corner parts of the nozzle from the trough interior whereby to form said side chambers extending along the bottom side corner parts of the nozzle.

4. A method according to claim 3, wherein the metal flows from the trough into the chambers through openings in said partition walls.

5. A method according to claim 4, wherein the partition walls comprise a pair of laterally spaced upright walls standing up from a floor of the trough to define inner side walls of said side chambers and chamber top walls extending laterally outwardly from the upper extremities of the upright walls.

6. A method according to claim 5, wherein said openings comprise a series of longitudinally spaced openings in each of the upright walls defining the inner side walls of the side chambers.

7. A method according to claim 4, wherein the molten metal is delivered downwardly into the trough in a series of discrete free falling streams spaced apart longitudinally of the trough to impinge on a bottom floor of the trough between the side chambers.

8. Apparatus for casting metal strip, comprising a pair of parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle, wherein the metal delivery nozzle comprises an upwardly opening elongate trough extending longitudinally of the nip to receive molten metal from the distributor, a pair of elongate nozzle chambers extending one along each side of a floor of the trough and extending upwardly therefrom, metal flow passages for flow of molten metal from the interior of the trough into the nozzle side chambers, and nozzle side outlets for flow of molten metal from the side chambers outwardly from the bottom of the delivery nozzle, and wherein an opening in said delivery nozzle above said trough is larger than an opening in said metal distributor through which said molten metal is delivered and the metal distributor is so constructed and arranged with respect to the delivery nozzle that molten metal is delivered downwardly into the trough between the side chambers in at least one free falling stream to impinge on the trough floor between the side chambers and to flow outwardly against the chamber side walls.

9. Apparatus according to claim 8, wherein the nozzle side outlets are elongate slots extending continuously substantially throughout the length of the nozzle.

10. Apparatus according to claim 8, wherein the nozzle side chambers are formed by partition walls disposed within the nozzle to divide off bottom side corner parts of the nozzle from the trough interior whereby to form said side chambers extending along the bottom side corner parts of the nozzle.

11. Apparatus according to claim 10, wherein said metal flow passages are formed by openings in said partition walls.

12. Apparatus according to claim 11, wherein the partition walls comprise a pair of laterally spaced upright walls standing up from a floor of the trough to define inner side walls of said side chambers and chamber top walls extending laterally outwardly from the upper extremities of the upright walls.

13. Apparatus according to claim 12, wherein the metal flow passages comprise a series of longitudinally spaced openings in each of the upright walls defining the inner side walls of the side chambers.

* * * * *